United States Patent [19]

Bonhomme

[11] Patent Number: 5,059,932

[45] Date of Patent: Oct. 22, 1991

[54] QUICK-ACTION CIRCUIT BREAKER ASSISTED BY A CONTROL CIRCUIT

[75] Inventor: Henri Bonhomme, Ans, Belgium

[73] Assignee: Acec Transport S.A., Charleroi, Belgium

[21] Appl. No.: 371,223

[22] Filed: Jun. 26, 1989

[30] Foreign Application Priority Data

Jun. 27, 1988 [EP] European Pat. Off. ..... 88870113.3

[51] Int. Cl.[5] ..... H01H 53/00

[52] U.S. Cl. ..... 335/147; 200/148 R

[58] Field of Search ..... 335/147–150; 200/148 R, 81 R, 144 B, 148 A

[56] References Cited

U.S. PATENT DOCUMENTS

| | | | |
|---|---|---|---|
| Re. 26,445 | 8/1968 | Jensen . | |
| 3,723,922 | 3/1973 | Loewer . | |
| 3,764,944 | 10/1973 | Erven . | |
| 3,787,648 | 1/1974 | Kawasaki . | |
| 4,209,680 | 6/1980 | Garzon | 200/148 R |
| 4,631,508 | 12/1986 | Cinquin et al. | 335/147 |
| 4,956,738 | 9/1990 | Defosse et al. . | |

FOREIGN PATENT DOCUMENTS

| | | |
|---|---|---|
| 2357048 | 1/1978 | France . |
| 2022346 | 12/1979 | United Kingdom . |

*Primary Examiner*—Leo P. Picard
*Assistant Examiner*—Lincoln Donovan
*Attorney, Agent, or Firm*—Foley & Lardner

[57] ABSTRACT

Quick-action circuit breaker assisted by a semi-conductor control circuit, comprising a repulsion coil, a repulsion disk (37) associated with a contact bridge (39) bearing the mobile contacts (41), the repulsion disk (37) interacting with the repulsion coil (35), and a bearing means for holding the contacts in the closed state, wherein the bearing means comprises a holding spring (27) acting on the repulsion disk (37) associated with the contact bridge (39) via a retaining ball (33) acting on the repulsion disk (37) associated with the contact bridge (39), which retaining ball (37) exerts a sufficient pressure to resist an imposed contact pressure and is arranged to be retractable when the disk (37) is repulsed under the action of the repulsion coil (35).

16 Claims, 2 Drawing Sheets

QUICK-ACTION CIRCUIT BREAKER ASSISTED BY A CONTROL CIRCUIT

BACKGROUND OF THE INVENTION

This invention relates to a quick-action current-limiting circuit breaker which can be used under medium voltage and is more specifically suited for electric traction, in rolling stock or fixed installations.

DESCRIPTION OF RELATED ART

It is well known that electric current networks such as those used in traction and in industry are becoming more and more complex and powerful. The design of switchgear has to develop in order to disconnect stronger and stronger currents and reduce maintenance costs. A switch of the new generation has to act quickly in order to limit the current and to reduce the mechanical and thermal stresses on the installation as a whole, and to reduce the wear on its contacts and its arc chute. At present, the switches include quick-action mechanisms for opening the contacts, and an arc chute in which the arc created is confined and cooled. These items of equipment entail significant costs because of the maintenance effort required and the replacement of worn components.

Various associations between mechanisms and semiconductor control circuits have been proposed.

U.S. Pat. Nos. 3,723,922 and 3,764,944 describe a mechanism intended for a synchronous switch for an alternating current system in which the axial displacement of a disk linked by a central shaft to a mobile contact bridge is brought about by repulsion, using helical coils excited by a substantial current originating from the discharge of a capacitor specifically designed for this use. This apparatus, designed for a high voltage alternating current system, operates under a high vacuum. It uses excitation coils which are complex to manufacture and special devices for decelerating the central shaft.

European Patent Application No. 85 870 134.5, now published as EP 184,566, which corresponds to U.S. Pat. No. 4,956,738 describes an apparatus in which the cut-off, without significant arc, is achieved by virtue of the addition of an oscillating circuit controlled by semiconductors, the choke coil of this circuit being used as a repulsion coil, to a quick-action electromagnetic locking device in which a single element acts simultaneously as a repulsion disk and as a mobile contact bridge.

The mechanism is associated with an oscillating circuit by means of power semi-conductors and comprises in particular:

a repulsion coil of a helical shape, located in an insulating compound and acting as a choke coil for the oscillating circuit, a metal disk acting as a contact bridge and interacting with the repulsion coil, a mobile assembly having an alternating movement, a permanent magnet or a locking winding and a magnet yoke inserted in this mobile assembly, and an armature interacting with the magnet yoke in combination with the disk.

In the case of the apparatus described therein, the repulsion effort obtained very rapidly achieves substantial proportions without, however, requiring substantial storage of energy in mechanical form (for example, the deformation of springs or the pressurization of a fluid).

Attempts were then made to improve the cut-off efficiency of this type of apparatus by means of a higher-performance control circuit which essentially inhibits the arcing and hence permits a longer service life and/or longer intervals between maintenance interventions.

It became apparent, however, that in some applications the mechanical part of the quick-action circuit breaker is subject to an excessive time-lag on opening and an inadequate speed of opening. The time-lag on opening is defined as being the time which elapses between the start of the command to open and the moment at which the mobile contacts begin to move away from the fixed contacts.

The speed of opening must, above all, be high at the beginning of the travel to obtain an adequate separation quickly.

This disadvantage of the circuit breaker of the abovementioned type is substantially due to the fact that the mobile part possesses a quite substantial moment of inertia since it has to be magnetic in order to cling to a permanent magnet or an electromagnet for the purpose of locking the contacts in the closed state and ensuring a specific contact pressure between the bridge carrying the mobile contacts and the fixed contacts.

OBJECTS AND SUMMARY OF THE INVENTION

The object of the invention consists in providing a quick-action circuit breaker suitable for medium and high voltages, assisted by a control circuit which comprises a particularly high-performance mechanical part.

An additional object of the present invention consists in providing a quick-action circuit breaker of the abovementioned type whose mobile parts possess a reduced moment of inertia relative to that which is known from the state of the art.

A further additional object of the present invention aims at providing a high-performance quick-action circuit breaker of particularly simple design which is strong and nevertheless inexpensive.

According to the present invention, the quick-action circuit breaker assisted by a semi-conductor control circuit, comprising a repulsion coil, a repulsion disk associated with a contact bridge bearing the mobile contacts, the repulsion disk interacting with the repulsion coil, and a means of holding the contacts in the closed state, is characterized in that the holding means comprises a retaining spring acting on the repulsion disk associated with the contact bridge via a holding means acting on the said repulsion disk, which holding means exerts a sufficient pressure to resist an imposed contact pressure and is arranged to be retractable when the disk is repulsed under the action of the repulsion coil.

On setting, the retaining spring is compressed and the circuit breaker is set by the action of compressed air. Once setting is complete, the retaining spring can release all its energy in order to apply the contact bridge, and hence the mobile contacts, against the fixed contacts. It is quite apparent that, in order to overcome the electrodynamic repulsion and with a view to limiting pre-arcing between the fixed and mobile contacts, it is necessary to provide a spring, preferably precompressed, of sufficient power.

According to an embodiment of the present invention, the repulsion disk comprises, on the side opposite that which is associated with the contact bridge, a shank on which the holding means acts.

Advantageously, the holding means is composed of a plurality of balls or rollers, preferably two or four balls or rollers, applied under pressure, possibly with the aid of a spring, against the shank which is fixed to the repulsion disk, preferably along axes oriented perpendicularly to the axis of the shank.

According to a preferred embodiment, the shank possesses a frustonconical surface which increases with increasing distance from the repulsion disk, or inclined planes which diverge from the axis of the said shank with increasing distance from the repulsion disk, the end of the frustonconical surface or of the inclined planes close to the repulsion disk being provided with a shoulder acting as a thrust bearing for the balls or rollers, and the end of the frustoconical surface or of the inclined planes remote from the repulsion disk possessing a groove to receive the balls or rollers, the distance separating the shoulder from the groove essentially corresponding to the travel of the mobile contacts.

It will readily be established that the mobile part, which has to undergo substantial accelerations during the breaking of the contacts, for example in the case of a short circuit, is reduced to a lightweight part of low moment of inertia, comprising simply the repulsion disk associated with the contact bridge and with the shank. It is of course possible further to improve the performance of this mobile part by selecting a suitable lightweight metal material.

Advantageously, the device according to the present invention comprises a damping means which damps the abrupt movement of the repulsion disk, together with its shank, when the electrical circuit is broken, that is to say when the disk is repulsed by the repulsion coil. In fact, whereas circuit breakers of the conventional type gave substantial accelerations of the mobile part, preliminary tests on the circuit breaker according to the present invention indicate accelerations greater than 30,000 g. It will therefore be readily understood that, in order to prevent destruction of the apparatus, it is necessary to provide at least one adequate damper.

In the state of rest, in other words with contacts open and breaker not set, the retaining spring is precompressed while the repulsion disk is positioned away from the fixed contacts, in other words the balls or rollers are bearing on the shank in the vicinity of the repulsion disk, specifically against the shoulder serving as a thrust bearing. In order to set the circuit breaker shown by way of example in the figures, compressed air is introduced into a suitable chamber, which compresses the retaining spring and displaces the retaining balls or rollers along the frustoconical surface or along the inclined planes, the repulsion disk being retained by a stop, until the said balls or rollers engage in the receiving groove at the free end of the shank fixed to the said repulsion disk.

The closing of the electrical circuit, that is to say the closing of the circuit breaker, has to take place rapidly and with a relatively substantial force in order to prevent pre-arcing and to overcome the electrodynamic forces of repulsion. By virtue of the release of the compressed air, preferably by contact with atmosphere, the retaining spring releases all its energy and applies the contact bridge with its mobile contacts against the fixed contacts, via the balls or rollers accommodated in the said receiving groove at the end of the shank.

When the repulsion coil is excited, the fixed and mobile contacts are abruptedly separated by virtue of the abrupt removal of the repulsion disk, whose shank bears on a damping means, the balls or rollers being abruptly moved away and dislodged from the groove in order to come to rest, at the end of the disk's travel, against the shoulder close to the repulsion disk. The retaining spring is not stressed by the repulsion, since the mobile part escapes from the pressure maintenance system. The inertia of the moving parts therefore varies in accordance with the direction of movement; high when the contacts close, minimum when they open.

DETAILED DESCRIPTION OF A PREFERRED EMBODIMENT

Figure 1:
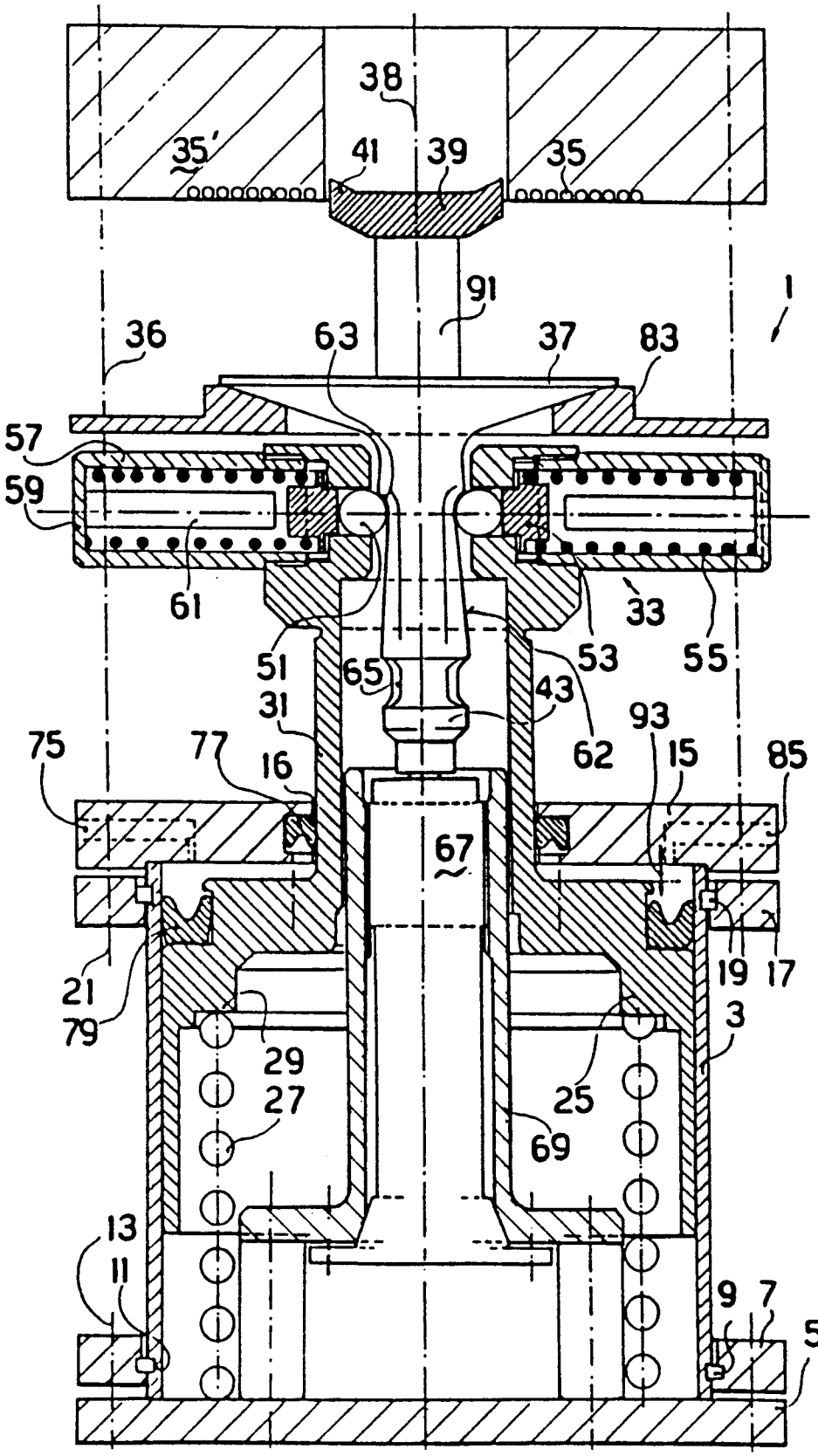
FIG. 1 shows the circuit breaker according to the present invention, in longitudinal section, in the position of rest.

In the figures, identical references indicate identical or similar elements.

The circuit breaker 1 according to the present invention comprises a cylinder 3, covered at one end by a bottom lid 5 which is fixed there by means of a flange 7 attached to a ring 9 accommodated in a corresponding groove 11 of the cylinder, the lid being clamped by means of adequate screws or bolts 13 and covered at the other end by a second lid 15 which is fixed in a similar manner by a flange 17, a ring 19 and screws or bolts 21.

The cylinder 3 comprises, on the inside, a piston 25 which can slide therein, and a holding spring 27 which bears on the bottom lid 5 and on a shoulder 29 formed in the piston. The piston is formed integral with a sleeve 31 which passes through the lid 15 in its corresponding central aperture 16. The sleeve 31 is connected at its free end with a retaining means bearing the general reference 33.

The circuit breaker according to the present invention cooperates with a repulsion coil 35, advantageously cast in a resin 35. The respective components of the device are connected by threaded rods or bolts 36.

The circuit breaker further comprises a repulsion disk 37 associated with a contact bridge 39 bearing the mobile contacts 41, and with a shank 43 described in more detail hereinafter.

The retaining means 33 is mounted on the end of the sleeve 31, for example by screwing, and comprises a plurality of balls or rollers 51 which are applied against the shank 43 of the repulsion disk 37 by means of adjustable pressure. In practice, a thruster 53 actuated by a spring 55 accommodated in a guide 57, which is preferably cylindrical and covered by a lid 59, and provided with a stop 61 preventing the retraction of the thruster, bears on a ball or roller 51.

The shank 43 is fixed to the repulsion disk 37. According to a first embodiment, the shank 43 takes the form of a frustoconical surface 62 provided, at the end close to the repulsion disk 37, with a shoulder 63 and, at the free end, with a groove 65. In this embodiment, which is used in combination with balls 51, the repulsion disk is free to rotate about its axis 38, which makes it possible to reduce the local wear on the mobile contacts 41.

According to another embodiment, the shank 43 preferably comprises 4 inclined planes 62 which diverge from the axis 38 as they move away from the repulsion disk 37. In this embodiment, used in combination with rollers 51, the specific pressure exerted by the retaining means is reduced. If, moreover, it is desired to reduce the wear on the mobile contacts, it is possible, after a number of maneuvers, to rotate the disk through 90° for example, if four rollers have been provided.

In the embodiment shown, the circuit breaker further comprises a damper 67 mounted within an axial guide 69 fixed to the bottom lid 5.

In the state of rest (FIG. 1), the spring 27, which is preferably precompressed, retains the piston 23 and hence the sleeve 31 in the high position, the repulsion disk being situated in the low position, remote from the repulsion coil, bearing on the balls or rollers 51 by means of the shoulder 63.

Figure 2:
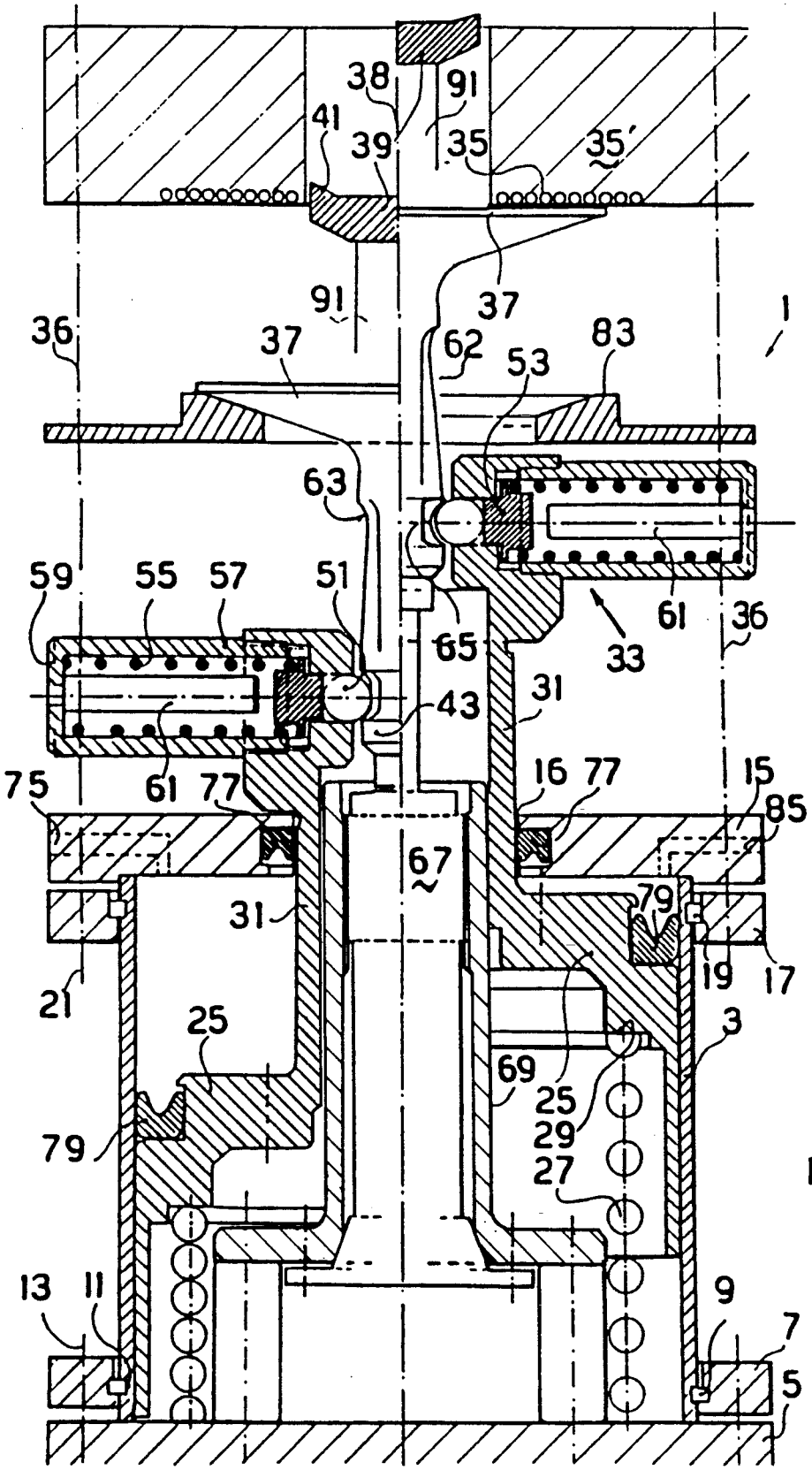
FIG. 2 is a longitudinal section similar to the previous figure, the left-hand part being shown in the set state and the right-hand part in the closed state.

In order to arm the circuit breaker according to the present invention (left-hand part of FIG. 2), it is necessary to introduce compressed air via the duct or ducts 75 made in the lid 15. The chamber defined by the wall of the cylinder 3, the lid 15 and the piston 25 fills with compressed air, and, under the pressure thus exerted, the holding spring 27 compresses and the piston 25 is lowered, taking with it the sleeve 31 and the retaining means 33. A gasket 77 maintains an air-tight seal between the sleeve 31 and the lid 15. Another gasket 79 is intended to maintain a seal between the piston 25 and the cylinder 3.

In order to prevent the retaining means 33 from taking with it the repulsion disk 37, in view of the pressure of the balls or rollers 51 on the surface 61 which is inclined relative to the axis 38, the disk 37 is retained by fixed stops 83.

It should be noted that the cylindrical wall of the piston 25 likewise acts as a mechanical stop for the spring 27, preventing the latter from being compressed to the point that the turns become contiguous. The cylindrical wall is further dimensioned in a manner such that, when the spring 27 is compressed to the maximum, the balls or rollers 51 engage in the annular groove 65.

To close the circuit breaker 1 according to the present invention in optimum conditions, that is to say relatively quickly, it is necessary to ensure that the holding spring 27 can quickly release the stored energy. To do this, the compressed air is vented via exhaust ducts 85. In this manner, pre-arcing is restricted.

The sleeve 31 fixed to the piston 25 takes with it, via the retaining means, and more specifically via the balls or rollers 51, the shank 43 and, consequently, the repulsion disk 37 until the contact bridge bearing the mobile contacts comes into contact with the fixed contacts.

The force of the spring 55 must therefore be sufficient to retain the balls or rollers 51 in the groove 65 during this stage and to ensure an optimum contact pressure.

Let us now assume that the current increases in an unacceptable manner within the electrical circuit in which the circuit breaker according to the present invention is inserted. In this case, the electrical control circuit sends a spike of current to the repulsion coil 35. The result is to establish a particularly high repulsion force which acts on the disk 37. This high force makes it possible to dislodge the balls or rollers 51 from the groove 65 by compressing the spring 55. The repulsion disk associated with the contact bridge 39 and with the shank 43 thus undergoes a particularly high acceleration, reducing the risk of arcing and of wear on the contacts.

The repulsion disk, having thus been accelerated, likewise has to be braked. The braking action is exerted by the damper 67 and by the balls or rollers 51, which likewise make it possible to accommodate the disk 37 in the position of rest in FIG. 1, by virtue of the shoulder 63.

In the figures, a contact bridge has been shown which is associated with the repulsion disk by means of a leg 91. In this case, the repulsion coil 35 advantageously has a diameter close to that of the repulsion disk. If a more substantial choke coil is desired, a coil 35 can be provided which is oversize relative to the diameter of the repulsion disk 37.

However, it is likewise possible to make provision for the contact bridge and repulsion disk to form a single piece, the mobile contacts then being arranged on the periphery of the repulsion disk.

It is of course necessary to provide the tolerances and play necessary for correct operation. In this context, mention may be made of a play 93 intended to absorb the wear on the contacts.

The circuit breaker according to the present invention can be combined with any electronic control circuit possessing a choke coil acting as a repulsion coil.

I claim:

1. A quick-action circuit breaker comprising:

(A) a repulsion coil;

(B) contacts which are movable from an open state to a closed state;

(C) a contact bridge which supports said contacts;

(D) a repulsion disk which is connected to said contact bridge and which is repulsed by the action of said repulsion coil; and (E) means for holding said contacts in said closed state, said means for holding comprising a retaining device which abuts said repulsion disk and a retaining spring which exerts a biasing force on said repulsion disk via said retaining device, which biasing force tends to retain said repulsion disk in a position in which said contacts are in their closed state, wherein said retaining device exerts a force on said repulsion disk which is sufficient to resist an imposed contact pressure and wherein said retaining device retracts when said repulsion disk is repulsed by said repulsion coil.

2. The circuit breaker as claimed in claim 1, wherein said repulsion disk includes first and second opposed ends extending axially in opposite directions from a disk portion, and wherein said first opposed end is connected to said contact bridge and said second opposed end comprises a shank which abuts said retaining device.

3. The circuit breaker as claimed in claim 2, wherein said retaining device comprises a plurality of rollers which are biased into engagement with a radial surface of said shank.

4. The circuit breaker as claimed in claim 3, wherein said shank has a frusto-conical surface which increases in diameter with increasing distance from said disk portion, wherein a shoulder is formed on an end of said shank proximate said disk portion and wherein receiving grooves for said rollers are formed in an end of said shank remote said disk portion, and wherein the distance separating said shoulder and said receiving grooves essentially corresponds to the distance said movable contacts travel when said disk is repulsed under the action of said repulsion coil.

5. The circuit breaker as claimed in claim 1, further comprising a cylinder covered by a bottom lid and by an upper lid having an axial aperture formed therein, a sleeve passing through said axial aperture formed in said lid and supporting said retaining device, a piston connected to said sleeve, said retaining spring being arranged between said bottom lid and a shoulder of said piston and being compressed by said piston when compressed air is introduced into a space defined within said cylinder, wherein said upper lid has at least one inlet duct and one exhaust duct formed therein which communicate with said space, and gaskets providing seals between said piston and said cylinder and between said piston and said upper lid, respectively.

6. The circuit breaker as claimed in claim 1, wherein said repulsion disk is formed integral with said contact bridge.

7. The circuit breaker as claimed in claim 1, further comprising a leg connecting said repulsion disk to said contact bridge.

8. The circuit breaker as claimed in claim 2, further comprising a damping device connected to said shank.

9. The circuit breaker as claimed in claim 8, wherein said shank acts as a mobile part of said damping device.

10. The circuit breaker as claimed in claim 1, further comprising an insulating resin encasing said repulsion coil.

11. The circuit breaker as claimed in claim 2, wherein said retaining device engages a groove formed in said shank when said repulsion disk in is said position in which said contacts are closed.

12. A circuit breaker comprising:

(A) a repulsion coil;

(B) contacts which are moveable between an open position and a closed position;

(C) a contact bridge onto which said moveable contacts are mounted;

(D) a repulsion disk having a first axial end connected to said contact bridge, said repulsion disk being retracted by the action of said repulsion coil from a first position in which said moveable contacts are closed to a second position in which said contacts are open;

(E) a shank connected to a second axial end of said repulsion disk;

(F) a retaining device which abuts said shank and which exerts a force on said shank which is sufficient to withstand a contact pressure exerted therebetween, said retaining device retracting when said repulsion disk is repulsed under the action of said repulsion coil; and (G) a retaining spring which exerts a force on said repulsion disk via said retaining device, which force tends to hold said repulsion disk in said first position.

13. The circuit breaker as claimed in claim 12, wherein said retaining spring acts axially on said retaining device and said retaining device acts radially on said shank.

14. The circuit breaker as claimed in claim 12, wherein said retaining device engages a groove formed in said shank when said repulsion disk in said first position.

15. The circuit breaker as claimed in claim 3, wherein said rollers comprise balls.

16. The circuit breaker of claim 5, further comprising an annular damping stop having a radial passage aperture formed therein.

* * * * *